US008779402B2

(12) United States Patent
Yabu et al.

(10) Patent No.: US 8,779,402 B2
(45) Date of Patent: Jul. 15, 2014

(54) TARGET SUPPLY DEVICE

(71) Applicant: Gigaphoton Inc., Oyama (JP)

(72) Inventors: Takayuki Yabu, Hiratsuka (JP); Yukio Watanabe, Hiratsuka (JP); Toshihiro Nishisaka, Hiratsuka (JP); Hiroshi Someya, Hiratsuka (JP); Osamu Wakabayashi, Hiratsuka (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 13/675,790

(22) Filed: Nov. 13, 2012

(65) Prior Publication Data

US 2013/0206863 A1 Aug. 15, 2013

(30) Foreign Application Priority Data

Feb. 14, 2012 (JP) ..... 2012-029276

(51) Int. Cl.
*G21K 5/00* (2006.01)

(52) U.S. Cl.
USPC ..... 250/504 R; 250/493.1

(58) Field of Classification Search
USPC ..... 250/493.1, 494.1, 504 R
See application file for complete search history.

(56) References Cited

U.S. PATENT DOCUMENTS

| | | | | |
|---|---|---|---|---|
| 7,378,673 | B2 | 5/2008 | Bykanov et al. | |
| 7,608,846 | B2 | 10/2009 | Nakano | |
| 7,838,854 | B2 | 11/2010 | Algots et al. | |
| 2013/0153792 | A1 * | 6/2013 | Baumgart et al. | 250/504 R |

FOREIGN PATENT DOCUMENTS

| | | | |
|---|---|---|---|
| JP | 2001-347370 | A | 12/2001 |
| JP | 2010-182555 | A | 8/2010 |

* cited by examiner

*Primary Examiner* — Nicole Ippolito
(74) *Attorney, Agent, or Firm* — McDermott Will & Emery LLP

(57) ABSTRACT

A target supply device includes a target supply device body including a nozzle having a through-hole through which a target material is discharged, a piezoelectric member having first and second surfaces and connected to the target supply device body at the first surface, the piezoelectric member being configured such that a distance between the first and second surfaces changes in according with an externally supplied electric signal, an elastic member having first and second ends and connected to the second surface of the piezoelectric member at the first end, the elastic member being configured such that a distance between the first and second ends extends or contract in accordance with an externally applied force, and a regulating member configured to regulate a distance between the second end of the elastic member and the target supply device body.

10 Claims, 12 Drawing Sheets

TARGET SUPPLY DEVICE

CROSS-REFERENCE TO RELATED APPLICATION

The present application claims priority from Japanese Patent Application No. 2012-029276 filed Feb. 14, 2012.

BACKGROUND

1. Technical Field

The present disclosure relates to target supply devices, for example, as used in EUV light generation devices.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed which combines a system for generating EUV light at a wavelength of approximately 13 nm with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

SUMMARY

A target supply device according to one aspect of the present disclosure may include a target supply device body including a nozzle having a through-hole through which a target material is discharged, a piezoelectric member having a first surface and a second surface and connected to the target supply device body at the first surface, the piezoelectric member being configured such that a distance between the first surface and the second surface changes in accordance with an externally supplied electric signal, an elastic member having a first end and a second end and connected to the second surface of the piezoelectric member at the first end, the elastic member being configured such that a distance between the first end and the second end extends or contracts in accordance with an externally applied force, and a regulating member configured to regulate a distance between the second end of the elastic member and the target supply device body.

A target supply device according to another aspect of the present disclosure may include a target supply device body including a nozzle having a through-hole through which a target material is discharged, an elastic member having a first end and a second end and connected to the target supply device body at the first end, the elastic member being configured such that a distance between the first end and the second end extends or contracts in according with an externally applied force, a piezoelectric member having a first surface and a second surface and connected to the second end of the elastic member at the first surface, the piezoelectric member being configured such that a distance between the first surface and the second surface changes in accordance with an externally supplied electric signal, and a regulating member configured to regulate a distance between the second surface of the piezoelectric member and the target supply device body.

BRIEF DESCRIPTION OF THE DRAWINGS

Hereinafter, several implementations of the present disclosure will be described with reference to the accompanying drawings.

DETAILED DESCRIPTION

Figure 1:
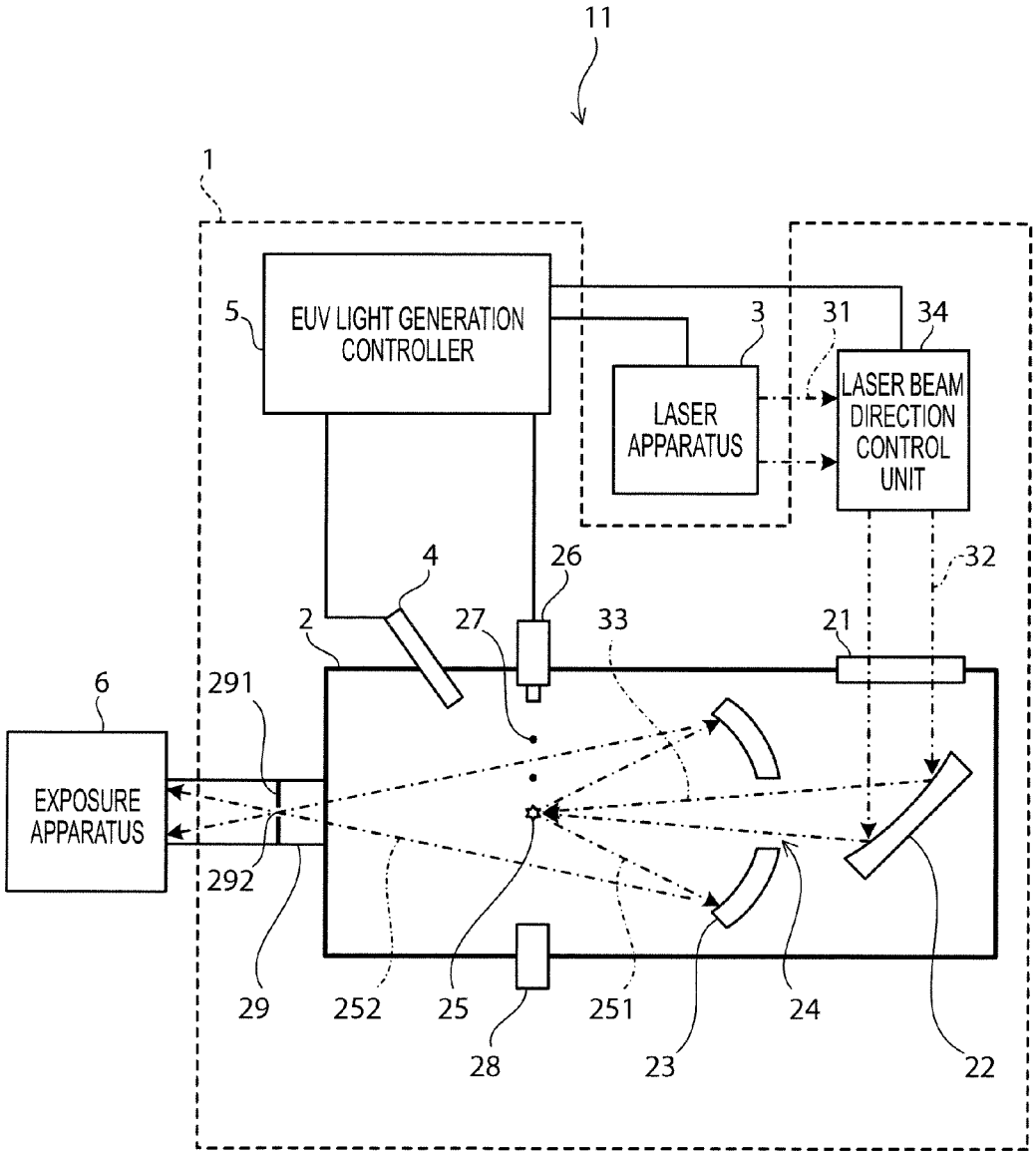
FIG. 1 schematically illustrates a configuration of an exemplary LPP-type EUV light generation system.

Hereinafter, selected examples of the present disclosure will be described in detail with reference to the accompanying drawings. The examples to be described below are merely illustrative in nature and do not limit the scope of the present disclosure. Further, the configuration(s) and operation(s) described in each example are not all essential in implementing the present disclosure. Note that like elements are referenced by like reference numerals and characters, and duplicate descriptions thereof will be omitted herein.

Contents

1. Overview
2. Overview of EUV Light Generation System
2.1 Configuration
2.2 Operation
3. Target Supply Device Including Vibration Device
3.1 Configuration
3.2 Operation
4. Examples of Vibration Device
4.1 First Example
4.2 Second Example
4.3 Third Example
4.4 Fourth Example 5. Mounting Location of Vibration Device
5.1 First Example
5.2 Second Example
5.3 Third Example

1. Overview

In an LPP-type EUV light generation apparatus, a target may be outputted from a target supply device toward a plasma generation region inside a chamber, and this target may be irradiated with a pulse laser beam in the plasma generation region. Then, the target may be turned into plasma, and EUV light may be emitted from the plasma.

To output a target from a target supply device, a nozzle of the target supply device may be pressurized by a piezoelectric member to vibrate. In order to provide sufficient vibration to the target supply device, a pressure may be applied in advance to the piezoelectric member.

However, when a pressure applied to the piezoelectric member changes, the trajectory or the speed of a target outputted from the target supply device may change. Further, a pressure to be applied in advance to the piezoelectric member may vary for each target supply device, and in turn the trajectory or the speed of a target outputted from the target supply device may vary for each target supply device.

According to one or more examples of the present disclosure, a first end of an elastic member may be connected to a piezoelectric member to be connected to a target supply device body, and a distance between a second end of the elastic member and the target supply device body may be controlled. Accordingly, a variation in a pressure applied in advance to the piezoelectric member may be suppressed.

2. Overview of EUV Light Generation System

2.1 Configuration

FIG. 1 schematically illustrates a configuration of an exemplary LPP-type EUV light generation system. An EUV light generation apparatus 1 may be used with at least one laser apparatus 3. Hereinafter, a system that includes the EUV light generation apparatus 1 and the laser apparatus 3 will be referred to as an EUV light generation system 11. As shown in FIG. 1 and described in detail below, the EUV light generation system 11 may include a chamber 2 and a target supply device 26. The chamber 2 may be sealed airtight. The target supply device 26 may be mounted onto the chamber 2, for example, to penetrate a wall of the chamber 2. A target material to be supplied by the target supply device 26 may include, but is not limited to, tin, terbium, gadolinium, lithium, xenon, or any combination thereof.

The chamber 2 may have at least one through-hole or opening formed in its wall, and a pulse laser beam 32 may travel through the through-hole or opening into the chamber 2. Alternatively, the chamber 2 may have a window 21, through which the pulse laser beam 32 may travel into the chamber 2. An EUV collector mirror 23 having a spheroidal surface may be provided in the chamber 2. The EUV collector mirror 23 may have a multi-layered reflective film formed on the spheroidal surface thereof. The reflective film may include a molybdenum layer and a silicon layer, which are alternately laminated. The EUV collector mirror 23 may have a first focus and a second focus, and may be positioned such that the first focus lies in a plasma generation region 25 and the second focus lies in an intermediate focus (IF) region 292 defined by the specification of an external apparatus such as an exposure apparatus 6. The EUV collector mirror 23 may have a through-hole 24 formed at the center thereof, and a pulse laser beam 33 may travel through the through-hole 24 toward the plasma generation region 25.

The EUV light generation system 11 may further include an EUV light generation controller 5 and a target sensor 4. The target sensor 4 may have an imaging function and detect at least one of the presence, the trajectory, the position, and the speed of a target 27.

Further, the EUV light generation system 11 may include a connection part 29 for allowing the interior of the chamber 2 to be in communication with the interior of the exposure apparatus 6. A wall 291 having an aperture may be provided in the connection part 29, and the wall 291 may be positioned such that the second focus of the EUV collector mirror 23 lies in the aperture formed in the wall 291.

The EUV light generation system 11 may also include a laser beam direction control unit 34, a laser beam focusing mirror 22, and a target collector 28 for collecting targets 27. The laser beam direction control unit 34 may include an optical element (not separately shown) for defining the direction into which the pulse laser beam 32 travels and an actuator (not separately shown) for adjusting the position and the orientation or posture of the optical element.

2.2 Operation

With continued reference to FIG. 1, a pulse laser beam 31 outputted from the laser apparatus 3 may pass through the laser beam direction control unit 34 and be outputted therefrom as a pulse laser beam 32 after having its direction optionally adjusted. The pulse laser beam 32 may travel through the window 21 and enter the chamber 2. The pulse laser beam 32 may travel inside the chamber 2 along at least one beam path from the laser apparatus 3, be reflected by the laser beam focusing mirror 22, and strike at least one target 27 as a pulse laser beam 33.

The target supply device 26 may be configured to output the target(s) 27 toward the plasma generation region 25 in the chamber 2. The target 27 may be irradiated with at least one pulse of the pulse laser beam 33. Upon being irradiated with the pulse laser beam 33, the target 27 may be turned into plasma, and rays of light 251 including EUV light may be emitted from the plasma. At least the EUV light included in the light 251 may be reflected selectively by the EUV collector mirror 23. EUV light 252, which is the light reflected by the EUV collector mirror 23, may travel through the intermediate focus region 292 and be outputted to the exposure apparatus 6. Here, the target 27 may be irradiated with multiple pulses included in the pulse laser beam 33.

The EUV light generation controller 5 may be configured to integrally control the EUV light generation system 11. The EUV light generation controller 5 may be configured to process image data of the target 27 captured by the target sensor 4. Further, the EUV light generation controller 5 may be configured to control at least one of the timing at which the target 27 is outputted and the direction into which the target 27 is outputted. Furthermore, the EUV light generation controller 5 may be configured to control at least one of the timing at which the laser apparatus 3 oscillates, the direction in which the pulse laser beam 31 travels, and the position at which the pulse laser beam 33 is focused. It will be appreciated that the various controls mentioned above are merely examples, and other controls may be added as necessary.

3. Target Supply Device Including Vibration Device

3.1 Configuration

Figure 2:
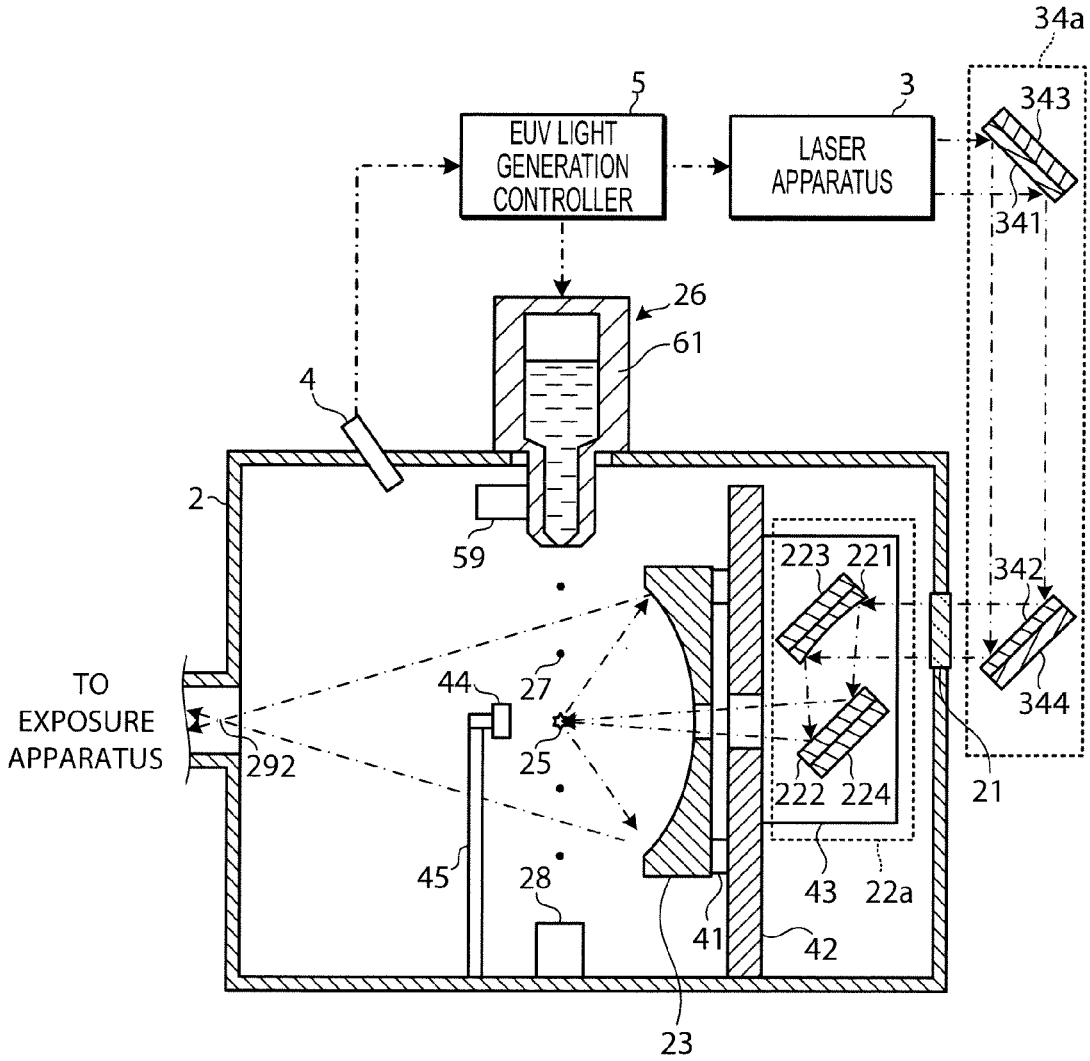
FIG. 2 is a partial sectional view illustrating an exemplary configuration of an EUV light generation apparatus including a target supply device of one implementation of the present disclosure.
Figure 3:
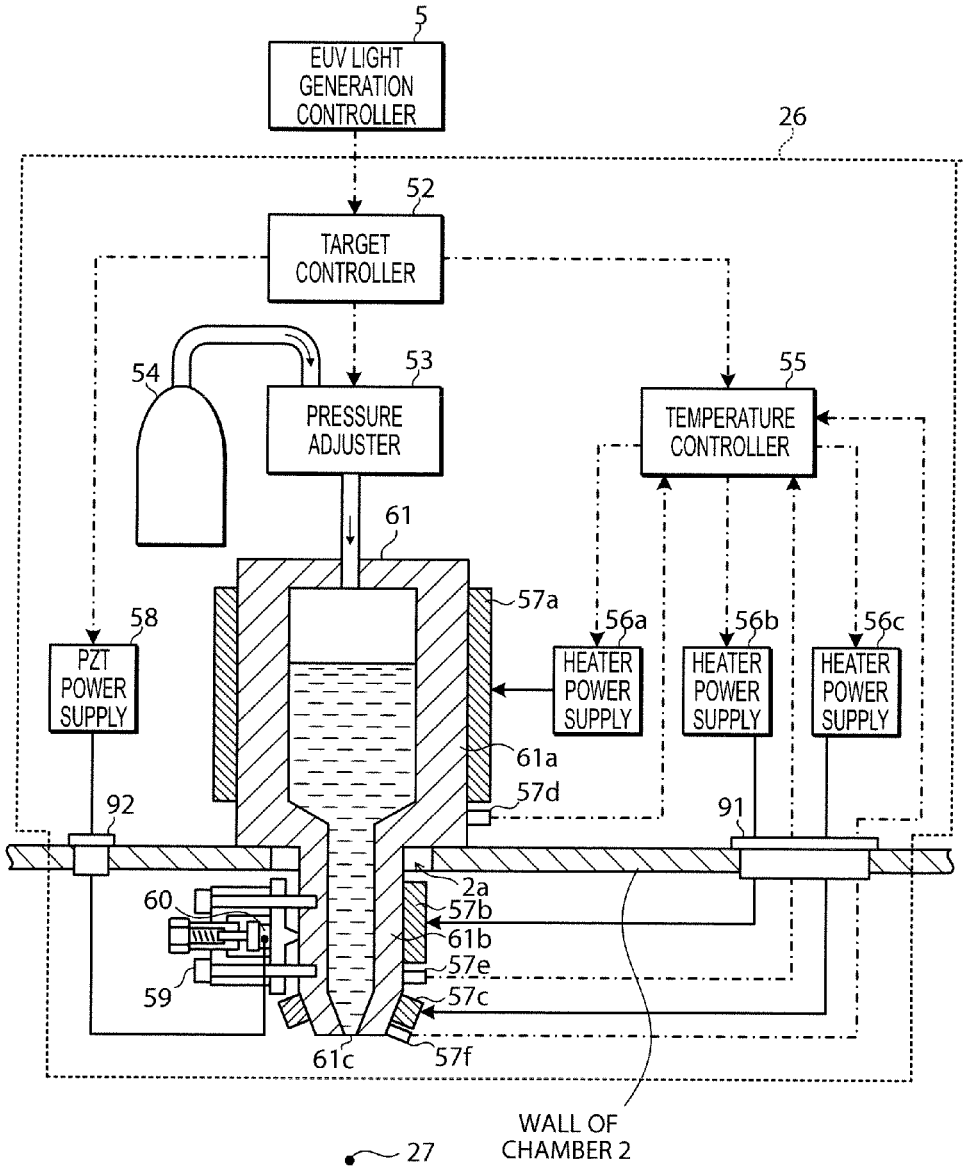
FIG. 3 is a sectional view illustrating a target supply device shown in FIG. 2 and peripheral components thereof.

FIG. 2 is a partial sectional view illustrating an exemplary configuration of an EUV light generation apparatus including a target supply device according to one implementation of the present disclosure. FIG. 3 is a sectional view illustrating a target supply device shown in FIG. 2 and peripheral components thereof. As shown in FIG. 2, a laser beam focusing optical system 22*a*, the EUV collector mirror 23, the target collector 28, an EUV collector mirror mount 41, plates 42 and 43, a beam dump 44, a beam dump support member 45 may be provided inside the chamber 2.

The plate 42 may be attached to the chamber 2, and the plate 43 may be attached to the plate 42. The EUV collector mirror 23 may be attached to the plate 42 through the EUV collector mirror mount 41.

The laser beam focusing optical system 22*a* may include an off-axis paraboloidal mirror 221, a flat mirror 222, and holders 223 and 224 for the respective mirrors 221 and 222. The off-axis paraboloidal mirror 221 and the flat mirror 222 may be mounted to the plate 43 through the respective mirror holders 223 and 224 such that a pulse laser beam reflected sequentially by the mirrors 221 and 222 is focused in the plasma generation region 25.

The beam dump 44 may be fixed to the chamber 2 through the beam dump support member 45 to be positioned in an extension of a beam path of a pulse laser beam reflected by the flat mirror 222. The target collector 28 may be provided in an extension of a designed trajectory of a target 27.

The target supply device 26 may be mounted to the chamber 2. As shown in FIG. 3, the target supply device 26 may include a reservoir 61, a target controller 52, a pressure adjuster 53, an inert gas cylinder 54, a temperature controller 55, heater power supplies 56*a* through 56*c*, a PZT power supply 58, and a vibration device 59.

The reservoir 61, which corresponds to a target supply device body, may be configured to store a target material in a molten state. The reservoir 61 may have a through-hole 61*c* through which the target material may be discharged. The reservoir 61 may include a first portion 61*a* and a second portion 61*b*. The first portion 61*a* may be larger in diameter than the second portion 61*b*. A heater 57*a* and a temperature sensor 57*d* may be provided on the first portion 61*a* to heat the target material and to monitor the temperature of the target material. A heater 57*b*, a temperature sensor 57*e*, a heater 57*c*, and a temperature sensor 57*f* may be provided on the second portion 61*b*. The heater 57*b* and the temperature sensor 57*e* may be provided toward the first portion 61*a*, and the heater 57*c* and the temperature sensor 57*f* may be provided toward the through-hole 61*c*.

A through-hole 2*a* may be formed in the wall of the chamber 2. The diameter of the through-hole 2*a* may be smaller than the outer diameter of the first portion 61*a* and larger than the outer diameter of the second portion 61*b*. The reservoir 61 may be fixed to the wall of the chamber 2 in a state where the second portion 61*b* is inserted into the through-hole 2*a* from the exterior of the chamber 2. Thus, the first portion 61*a* may be located outside the chamber 2, and the second portion 61*b* may be located inside the chamber 2.

The target controller 52 may be configured to output control signals to the pressure adjuster 53, the temperature controller 55, and the PZT power supply 58, respectively. The inert gas cylinder 54 may be connected to the pressure adjuster 53 through a pipe, and the pressure adjuster 53 may be in communication with the interior of the reservoir 61 through another pipe.

The temperature controller 55 may be connected to each of the heater power supplies 56*a* through 56*c* through a signal line. The heater power supplies 56*a* through 56*c* may be connected to the heaters 57*a* through 57*c* through respective wires. Each of the temperature sensors 57*d* through 57*f* may be connected to the temperature controller 55 through a signal line. Wires for connecting the heater power supplies 56*b* and 56*c* to the respective heaters 57*b* and 57*c* and wires for connecting the temperature sensors 57*e* and 57*f* to the temperature controller 55 may pass through the wall of the chamber 2 through a feedthrough 91.

The vibration device 59 may include a piezoelectric member 60. The piezoelectric member 60 may include a piezoelectric material such as lead zirconate titanate (PZT). The PZT power supply 58 may be connected to the piezoelectric member 60 through a wire, and the wire may pass through the wall of the chamber 2 through a feedthrough 92.

Referring back to FIG. 2, a beam steering unit 34*a* and the EUV light generation controller 5 may be provided outside the chamber 2. The beam steering unit 34*a* may include high-reflection mirrors 341 and 342 and holders 343 and 344 for the respective mirrors 341 and 342.

3.2 Operation

The temperature controller 55 may control currents to be passed through the heaters 57*a* through 57*c* by the respective heater power supplies 56*a* through 56*c* in accordance with a control signal from the target controller 52. As the heaters 57*a* through 57*c* are supplied with current to emit heat, the target material stored in the reservoir 61 may be heated to a temperature equal to or higher than its melting point. When tin is used as a target material, its melting point is 232° C. Here, the vicinity of the through-hole 61*c* may be brought to a temperature higher than that of the rest of the reservoir 61 so that generation of a deposit around the through-hole 61*c* is suppressed. For example, temperatures Td, Te, and Tf detected by the respective temperature sensors 57*d*, 57*e*, and 57*f* may be controlled to satisfy a relationship of $Tf>Te>Td\geq Tm$, where Tm is the melting point of a target material.

The pressure adjuster 53 may be configured to adjust a pressure of the inert gas supplied from the inert gas cylinder 54 in accordance with a control signal from the target controller 52. The inert gas introduced into the reservoir 61 may pressurize the molten target material inside the reservoir 61. As the molten target material is pressurized by the inert gas, a jet of the target material may be discharged through the through-hole 61*c* formed at the leading end of the second portion 61*b*.

The PZT power supply 58 may be configured to apply an AC voltage to the piezoelectric member 60 to cause the piezoelectric member 60 to deform cyclically in accordance with a control signal from the target controller 52. Thus, the piezoelectric member 60 may apply vibration to the reservoir 61. The vibration applied to the reservoir 61 may be propagated to at least the vicinity of the through-hole 61*c*. Then, the jet of the target material may be divided into a plurality of droplets to serve as targets 27. According to the Rayleigh-Taylor instability theory, when a jet of a target material having a diameter d and flowing at a speed v is disturbed by a vibration at a frequency f, if the frequency f satisfies a predetermined condition, a group of droplets of a substantially equal size is produced at the frequency f. The frequency f at this time is called a Rayleigh frequency.

For example, when the diameter of the through-hole 61*c* in the reservoir 61 is 6 μm and the pressure of the inert gas is adjusted to 12.5 MPa by the pressure adjuster 53, the piezoelectric member 60 of the vibration device 59 may apply a vibration to the reservoir 61 at a frequency in a range from 1.25 MHz to 3.3 MHz. Alternatively, when the diameter of the through-hole 61*c* is 15 μm and the adjusted pressure of the inert gas is 1 MPa, the piezoelectric member 60 may apply a vibration to the reservoir 61 at a frequency in a range from 14 kHz to 420 kHz.

A target 27 outputted into the chamber 2 as described above may be supplied to the plasma generation region 25 inside the chamber 2. A pulse laser beam from the laser apparatus 3 may be reflected by the high-reflection mirrors 341 and 342, and may enter the laser beam focusing optical system 22*a* through the window 21. The pulse laser beam that has entered the laser beam focusing optical system 22*a* may be reflected sequentially by the off-axis paraboloidal mirror 221 and the flat mirror 222 to be focused on the target 27 in the plasma generation region 25.

4. Examples of Vibration Device

4.1 First Example

Figure 4A:
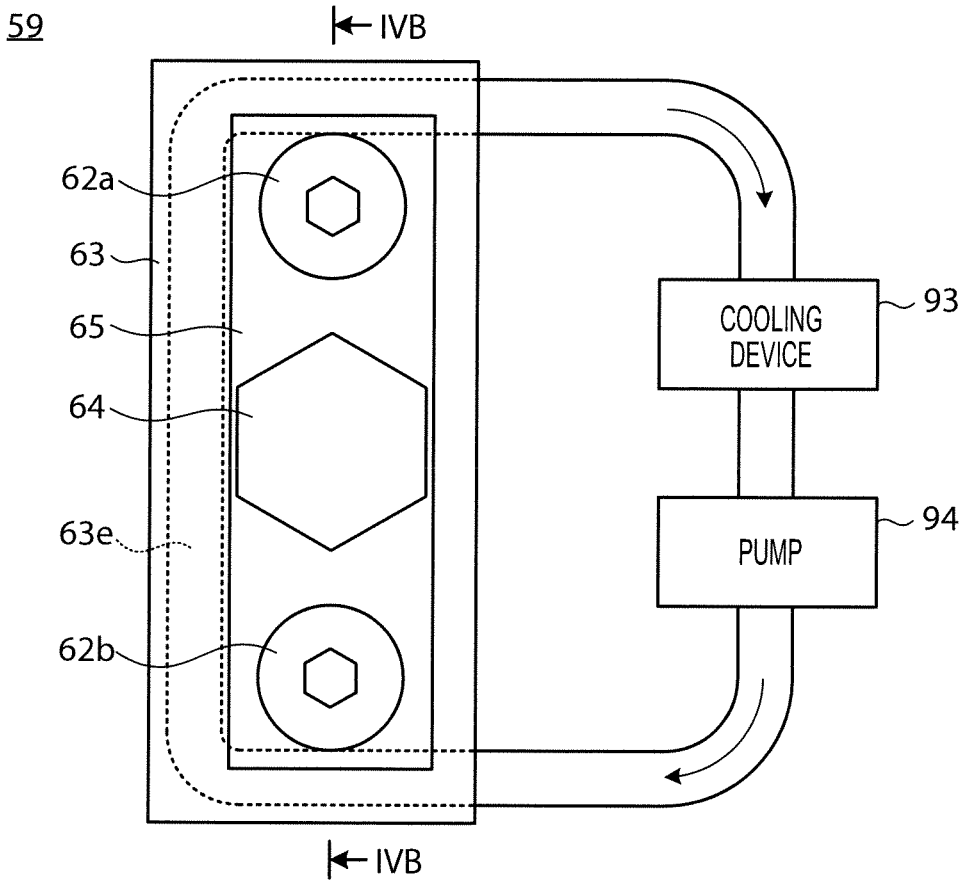
FIG. 4A is a front view illustrating a first example of a vibration device.
Figure 4B:
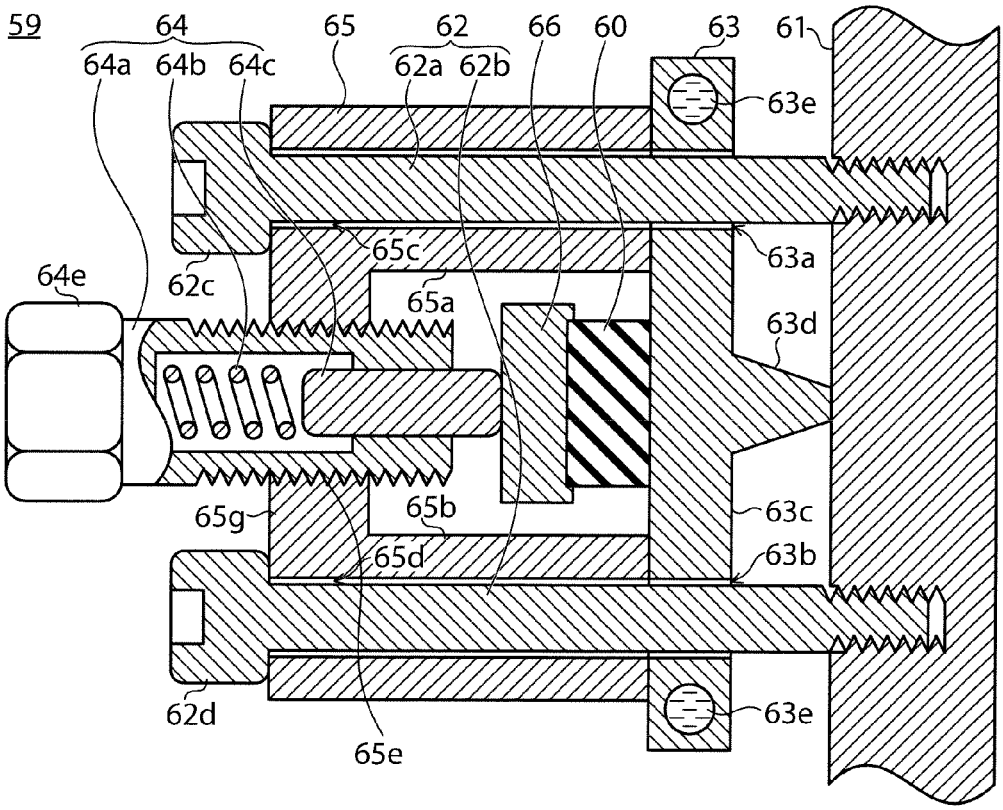
FIG. 4B is a sectional view of the vibration device shown in FIG. 4A, taken along IVB-IVB plane.

FIG. 4A is a front view illustrating a first example of a vibration device. FIG. 4B is a sectional view of the vibration device shown in FIG. 4A, taken along IVB-IVB plane.

A vibration device 59 may include a piezoelectric member 60, a fixing member 62, an intermediate member 63, a plunger screw 64, and a holding unit 65. The fixing member 62 may include bolts 62*a* and 62*b* that are screwed and fixed into the reservoir 61 at respective leading ends thereof. The intermediate member 63 may include a plate portion 63*c* and a protrusion 63*d* protruding from a first surface of the plate portion 63*c*. Through-holes 63*a* and 63*b* may be formed in the plate portion 63*c*, and the bolts 62*a* and 62*b* are inserted respectively into the through-holes 63*a* and 63*b*. There may be spaces between the surfaces of the bolts 62*a* and 62*b* and the inner wall of the respective through-holes 63*a* and 63*b*. The protrusion 63*d* may be in contact with the reservoir 61.

The piezoelectric member 60 may be provided on a second surface of the plate portion 63*c*. The piezoelectric member 60 may be sandwiched and fixed between a holding member 66 and the intermediate member 63. That is, the piezoelectric member 60 may be connected to the intermediate member 63 at a first surface thereof and to the holding member 66 at a second surface thereof. The piezoelectric member 60 may be configured such that the distance between the first and second surfaces thereof changes in accordance with a voltage from the PZT power supply 58 (see FIG. 3).

The holding unit 65 may include leg portions 65*a* and 65*b* and a holding plate 65*g* integrally formed with the leg portions 65*a* and 65*b*. Through-holes 65*c* and 65*d* may be formed in the leg portions 65*a* and 65*b*, respectively, into which the respective bolts 62*a* and 62*b* may be inserted. There may be spaces between the surfaces of the bolts 62*a* and 62*b* and the inner wall of the through-holes 65*c* and 65*d*, respectively. The holding unit 65 and the intermediate member 63 may be sandwiched and fixed between bolt heads 62*c* and 62*d* of the bolts 62*a* and 62*b* and the reservoir 61. An internally threaded through-hole 65*e* may be formed in the holding plate 65*g*, and the plunger screw 64 may be screwed into the internally threaded through-hole 65*e*.

The plunger screw 64 may include an exterior part 64*a* serving as a regulating member, a spring 64*b*, and a pin 64*c*. An external thread may be formed around the exterior part 64*a*, and the exterior part 64*a* may be screwed into the through-hole 65*e* in the holding plate 65*g*. A bolt head 64*e* may be formed at a first end of the exterior part 64*a*. A cylindrical hollow space may be formed inside the exterior part 64*a*, and this hollow space may open at a second end of the exterior part 64*a*.

The spring 64*b* may be housed in the hollow space inside the exterior part 64*a*. The spring 64*b* may have a first end positioned toward the second end of the exterior part 64*a* and a second end positioned toward the bolt head 64*e*. The first end of the spring 64*b* may be connected the pin 64*c* that in turn is connected to the holding member 66.

A part of the pin 64*c* may be inserted into the hollow space inside the exterior part 64*a* and the remaining part thereof may be exposed through the opening formed therein to be in contact with the holding member 66. The pin 64*c* may be movable along an axial direction of the exterior part 64*a*. As the pin 64*c* moves, the distance between the first and second ends of the spring 64*b* may change. The direction in which the spring 64*b* extends or contracts, the direction in which the pin 64*c* moves, and the direction in which the piezoelectric member 60 deforms may substantially coincide with one another.

By adjusting an amount in which the exterior part 64*a* is screwed into the holding unit 65, the distance between the second end of the spring 64*b* and the reservoir 61 may be controlled. Then, the length of the spring 64*b* may be adjusted, and compressive stress of the spring 64*b* may be adjusted. Therefore, a pressure applied to the piezoelectric member 60 by the spring 64*b* through the pin 64*c* and the holding member 66 may be adjusted. In this way, a variation in the pressure applied to the piezoelectric member 60 may be suppressed, and a variation in the trajectory or the speed of a target outputted from the target supply device may be suppressed.

A resonance frequency of the spring 64*b* may differ from a vibration frequency of the piezoelectric member 60 determined by an AC voltage from the PZT power supply 58 (see FIG. 3). The resonance frequency of the spring 64*b* may be significantly lower than the vibration frequency of the piezoelectric member 60. Then, the vibration of the piezoelectric member 60 may be propagated to the reservoir 61.

As stated above, the reservoir 61 may be heated to a temperature equal to or higher than the melting point of the target material. For example, the reservoir 61 may be heated to a temperature in a range from 232° C. to 370° C. However, when the piezoelectric member 60 is formed of PZT, the Curie point thereof is generally in a range from 150° C. to 350° C., and thus overheating of the piezoelectric member 60 should be prevented.

Therefore, a cooling water flow channel 63*e* may be formed inside the intermediate member 63. The cooling water flow channel 63*e* may be connected to a cooling device 93 and a pump 94. A fluid such as water cooled in the cooling device 93 may be circulated by the pump 94, and thus the temperature of the intermediate member 63 and the piezoelectric member 60 may be adjusted to a temperature equal to or lower than the boiling point of the fluid.

Further, in order to prevent the intermediate member 63 and the piezoelectric member 60 from being overheated by heat conducted from the reservoir 61, an area of contact between the intermediate member 63 and the reservoir 61 may be small. Accordingly, the protrusion 63*d* of the intermediate member 63 may have a small area at the leading end thereof which comes into contact with the reservoir 61. The area of contact between the intermediate member 63 and the reservoir 61 may be smaller than a sectional area of the piezoelectric member 60 along a plane parallel to its first and second surfaces.

4.2 Second Example

Figure 5:
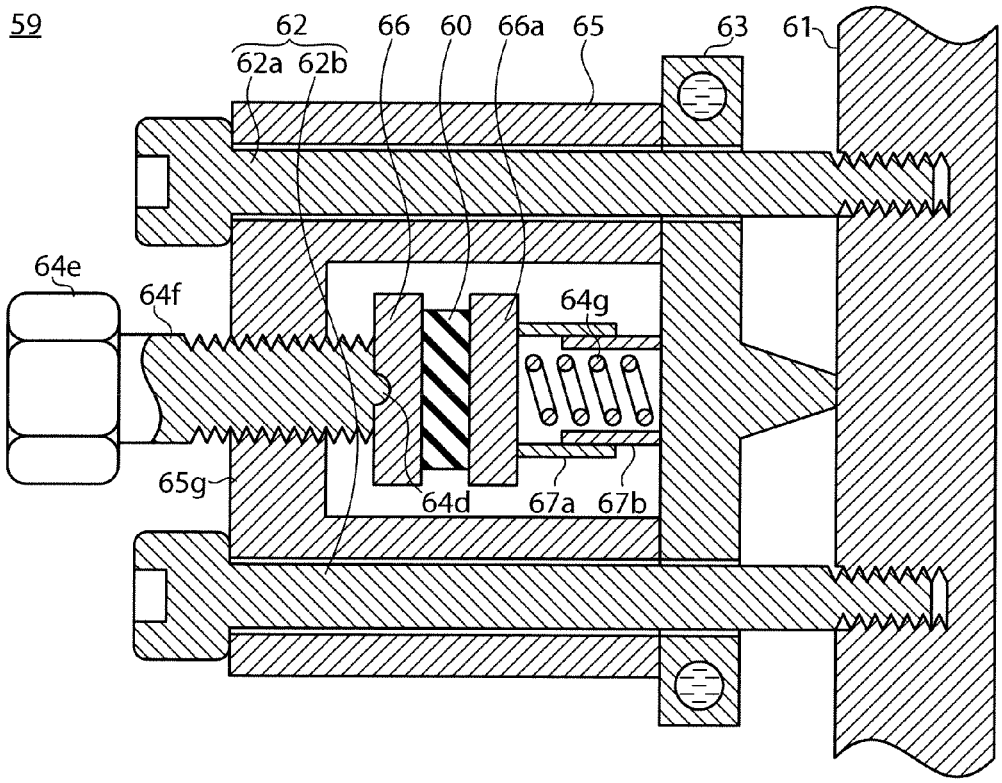
FIG. 5 is a sectional view illustrating a second example of a vibration device.

FIG. 5 is a sectional view illustrating a second example of a vibration device. In the second example, a vibration device 59 may include an adjusting bolt 64*f* serving as a regulating member and a spring 64*g* in place of the plunger screw 64 of the first example as shown in FIG. 4B. The bolt head 64*e* may be formed at a first end of the adjusting bolt 64*f*. A second end of the adjusting bolt 64*f* may be screwed into the holding plate 65*g*, and may be in contact with the holding member 66 through the holding plate 65*g*. A protrusion 64*d* may be formed at the second end of the adjusting bolt 64*f*, and the protrusion 64*d* may be fitted into a recess formed in the holding member 66.

The spring 64*g* may be provided between the piezoelectric member 60 and the intermediate member 63 with a receiving member 66*a* being provided between the piezoelectric member 60 and the spring 64*g*. The receiving member 66*a* and the intermediate member 63 may include cylindrical hollow members 67*a* and 67*b*, respectively, each having an opening at a leading end thereof. The inner diameter of the cylindrical hollow member 67*a* may be slightly larger than the outer diameter of the cylindrical hollow member 67*b*, and the cylindrical hollow member 67*b* may be inserted into the cylindrical hollow member 67*a*. As an amount in which the adjusting bolt 64*f* is screwed into the holding member 65 is adjusted, the cylindrical hollow member 67*b* may move inside the cylindrical hollow member 67*a* at an amount substantially the same as the aforementioned adjustment amount, and thus the spring 64*g* may extend or contract. The direction in which the spring 64*b* extends or contracts and the direction in which the piezoelectric member 60 deforms may substantially coincide with each other.

In the second example as well, by adjusting the amount in which the adjusting bolt 64*f* is screwed into the holding member 65, the distance between the second end of the piezoelectric member 60 and the reservoir 61 may be controlled, and the length of the spring 64*g* may be adjusted. Accordingly, a pressure applied to the piezoelectric member 60 by the spring 64*g* may be adjusted.

4.3 Third Example

Figure 6:
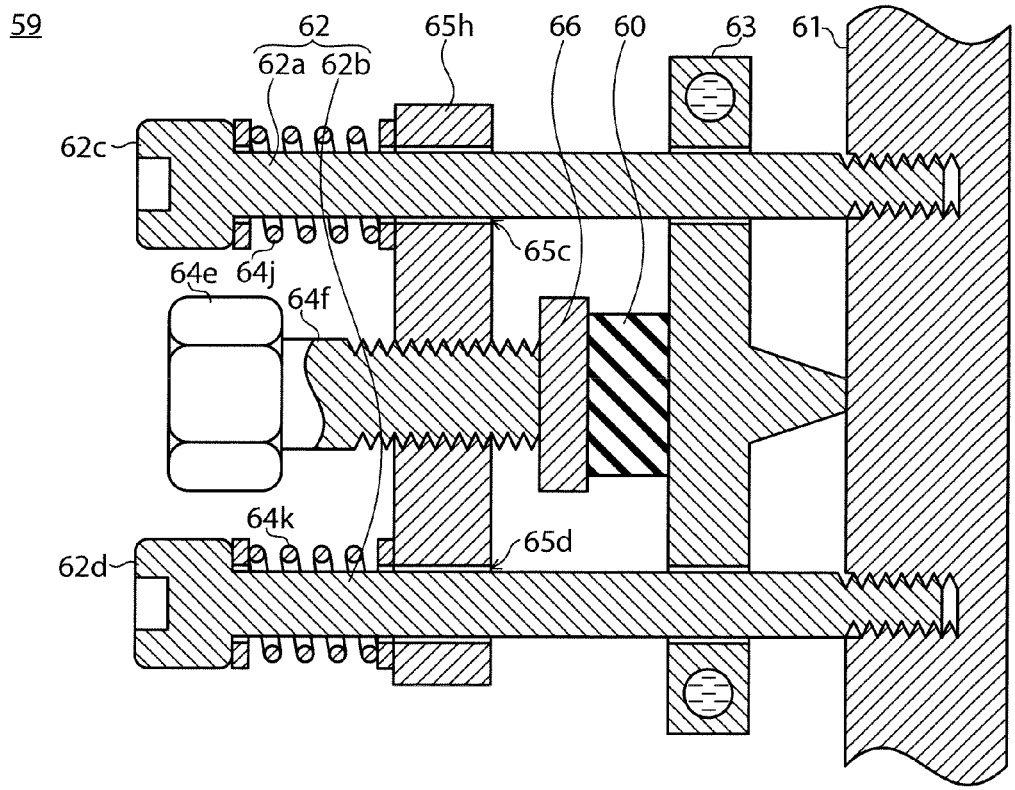
FIG. 6 is a sectional view illustrating a third example of a vibration device.

FIG. 6 is a sectional view illustrating a third example of a vibration device. In the third example, a vibration device 59 may include a holding plate 65*h*, the adjusting bolt 64*f*, and springs 64*j* and 64*k*, in place of the plunger screw 64 and the holding unit 65 of the first example shown in FIG. 4B.

The through-holes 65*c* and 65*d* may be formed in the holding plate 65*h*, and the bolts 62*a* and 62*b* serving as regulating members are inserted into the respective through-holes 65*c* and 65*d* with slight spaces therebetween. Thus, the holding plate 65*h* may be movable along the bolts 62*a* and 62*b*. The springs 64*j* and 64*k* may be provided between the holding plate 65*h* and the bolt heads 62*c* and 62*d* of the respective bolts 62*a* and 62*b*. The positions of first ends of the respective springs 64*j* and 64*k* may be regulated by the bolt heads 62*c* and 62*d*. The bolt head 64*e* may be formed at the first end of the adjusting bolt 64*f*. The second end of the adjusting bolt 64*f* may be screwed into the holding plate 65*h*, and may be in contact with the holding member 66 through the holding plate 65*h*. The direction in which the springs 64*j* and 64*k* extend or contract and the direction in which the piezoelectric member 60 deforms may substantially coincide with each other.

In the third example as well, by adjusting an amount in which the adjusting bolt 64*f* is screwed into the holding plate 65*h*, the length of the springs 64*j* and 64*k* may be adjusted. Accordingly, a pressure applied to the piezoelectric member 60 by the springs 64*j* and 64*k* through the holding plate 65*h*, the adjusting bolt 64*f*, and the holding member 66 may be adjusted.

4.4 Fourth Example

Figure 7A:
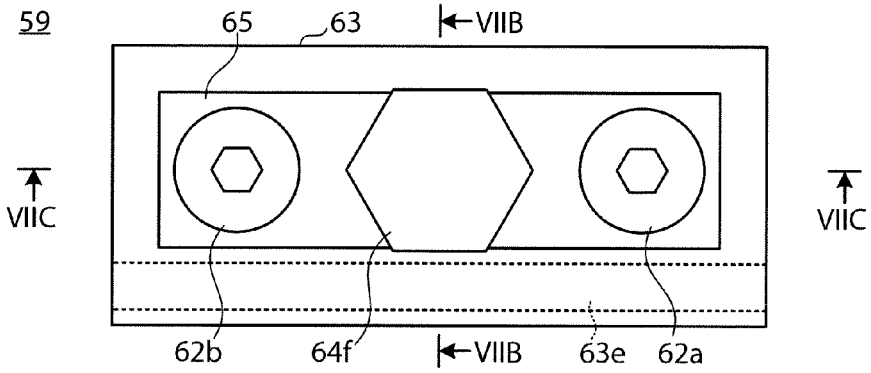
FIG. 7A is a front view illustrating a fourth example of a vibration device.
Figure 7B:
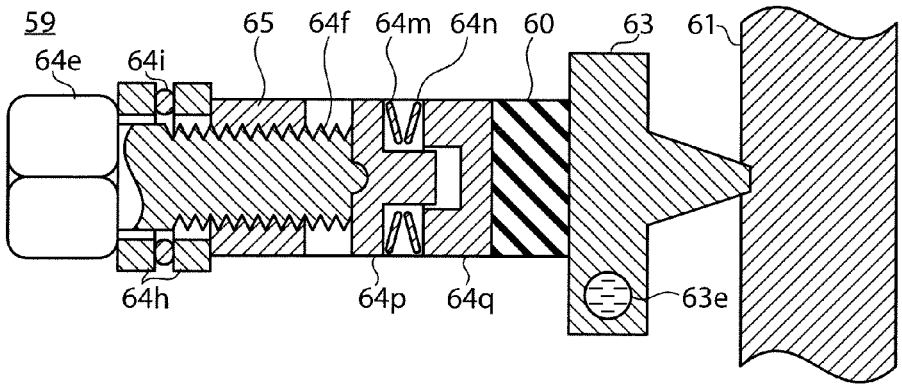
FIG. 7B is a sectional view of the vibration device shown in FIG. 7A, taken along VIIB-VIIB plane.
Figure 7C:
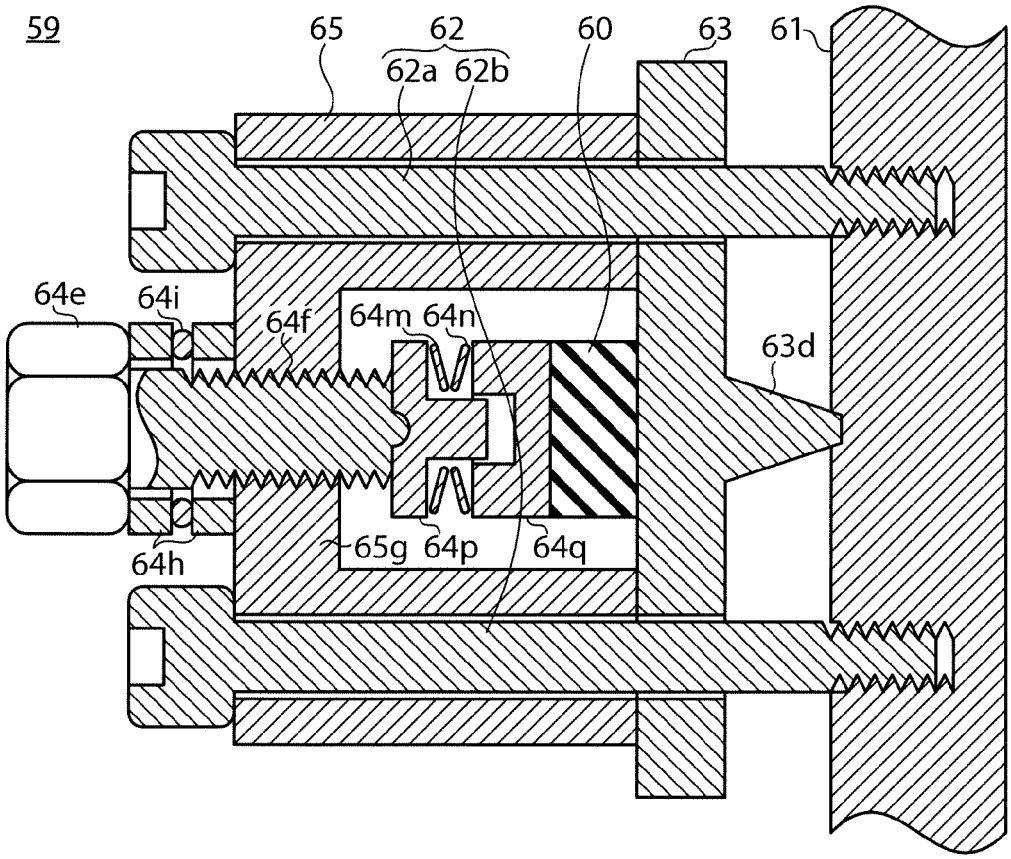
FIG. 7C is another sectional view of the vibration device shown in FIG. 7A, taken along VIIC-VIIC plane.

FIG. 7A is a plan view illustrating a fourth example of a vibration device. FIG. 7B is a sectional view of the vibration device shown in FIG. 7A, taken along VIIB-VIIB plane. FIG. 7C is another sectional view of the vibration device shown in FIG. 7A, taken along VIIC-VIIC plane. In the fourth example, a vibration device 59 may include the adjusting bolt 64*f* serving as a regulating member and disc springs 64*m* and 64*n* in place of the plunger screw 64 of the first example (see FIG. 4B).

The disc springs 64*m* and 64*n* may be stacked in series between a disc spring holder 64*p* and a disc spring receiver 64*q*. The bolt head 64*e* may be formed at the first end of the adjusting bolt 64*f*. The second end of the adjusting bolt 64*f* may be screwed into the holding plate 65*g*, and may be in contact with the disc spring holder 64*p* through the holding plate 65*g*.

The piezoelectric member 60 may be provided between the disc spring receiver 64*q* and the intermediate member 63. The direction in which the disc springs 64*m* and 64*n* extend or contract and the direction in which the piezoelectric member 60 deforms may substantially coincide with each other. By using the disc springs 64*m* and 64*n*, the dimension of the vibration device 59 in the direction in which the disc springs 64*m* and 64*n* extend or contract may be adjusted.

In the fourth example as well, by adjusting an amount in which the adjusting bolt 64*f* is screwed into the holding unit 65, the disc springs 64*m* and 64*n* may extend or contract. Thus, a pressure applied to the piezoelectric member 60 may be adjusted. An amount in which the adjusting bolt 64*f* is screwed into the holding unit 65 may be regulated with a washer 64*h* and a shim 64*i* provided between the bolt head 64*e* and the holding plate 65*g*.

The protrusion 63*d* of the intermediate member 63 may be fitted into a recess formed in the reservoir 61. Accordingly, the position of the intermediate member 63 relative to the reservoir 61 may be stabilized.

5. Mounting Location of Vibration Device

5.1 First Example

Figure 8A:
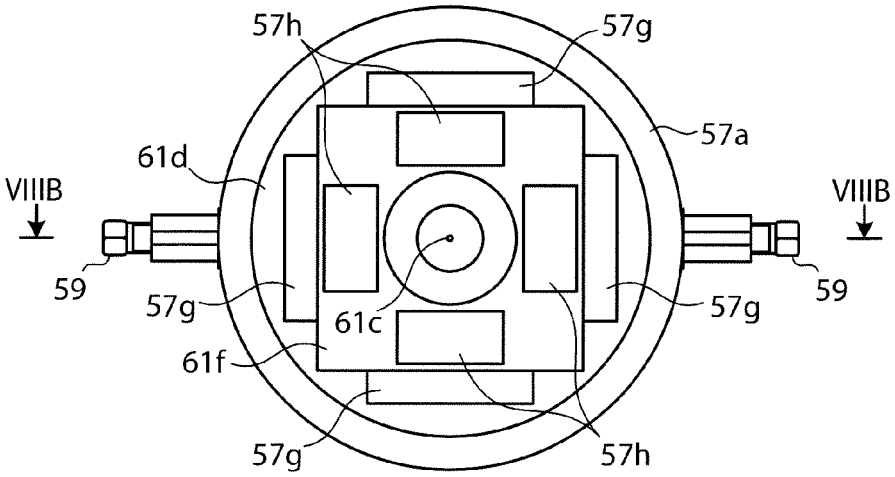
FIG. 8A is a bottom view illustrating a first example of a target supply device.
Figure 8B:
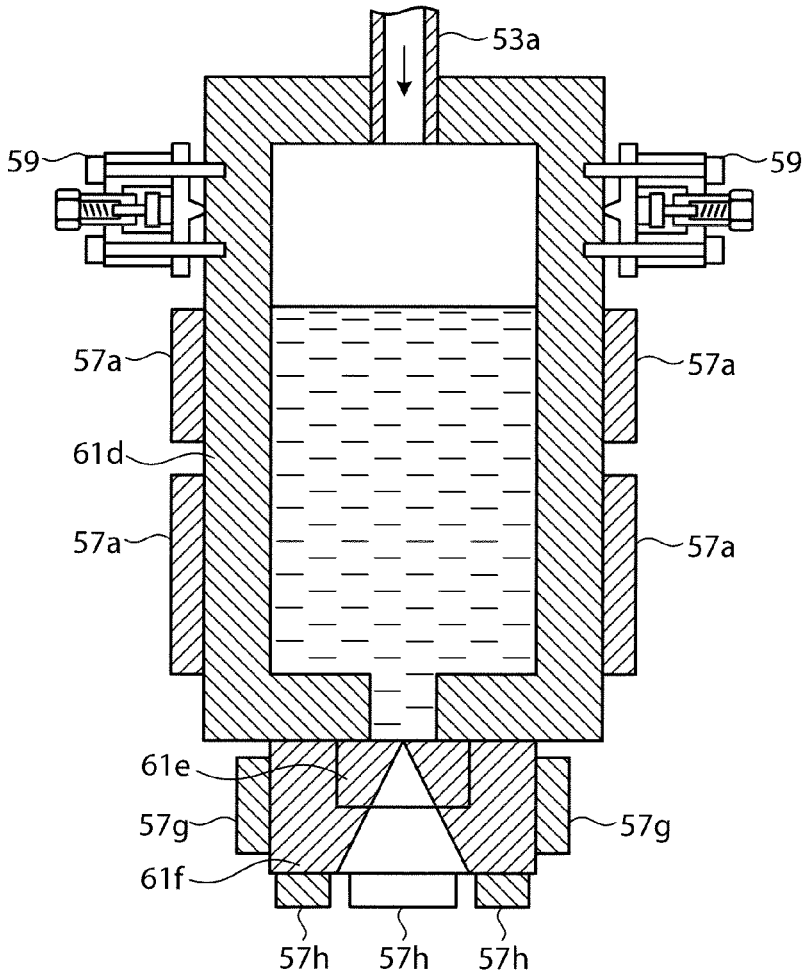
FIG. 8B is a sectional view of the target supply device shown in FIG. 8A, taken along VIIIB-VIIIB plane.

FIG. 8A is a bottom view illustrating a first example of a target supply device. FIG. 8B is a sectional view of the target supply device shown in FIG. 8A, taken along VIIIB-VIIIB plane.

In the first example, a target supply device body may include a reservoir 61*d* and a nozzle member 61*e* having a fine through-hole 61*c* formed therein. The nozzle member 61*e* may be fixed to the lower end of the reservoir 61*d* through a nozzle fixing member 61*f*. The heater 57*a* may be provided on the outer surface of the reservoir 61*d*, a heater 57*g* may be provided on the outer surface of the nozzle fixing member 61*f*, and a heater 57*h* may be provided on the bottom surface of the nozzle fixing member 61*f*.

An inert gas may be supplied into the reservoir 61*d* through a pipe 53*a* connected at the upper end of the reservoir 61*d*. Thus, a jet of a target material may be discharged through the through-hole 61*c*.

The vibration device 59 may be fixed toward the upper end of the reservoir 61*d*. A plurality of vibration devices 59 may be arranged symmetrically about the axis of the reservoir 61*d* as shown in FIG. 8A. Alternatively, the vibration device 59 may be provided singly.

A vibration applied to the vicinity of the upper end of the reservoir 61*d* by the vibration device 59 may be propagated to the nozzle member 61*d* through the rigid reservoir 61*d*. Accordingly, the jet of the target material may be divided into a plurality of droplets.

5.2 Second Example

Figure 9A:
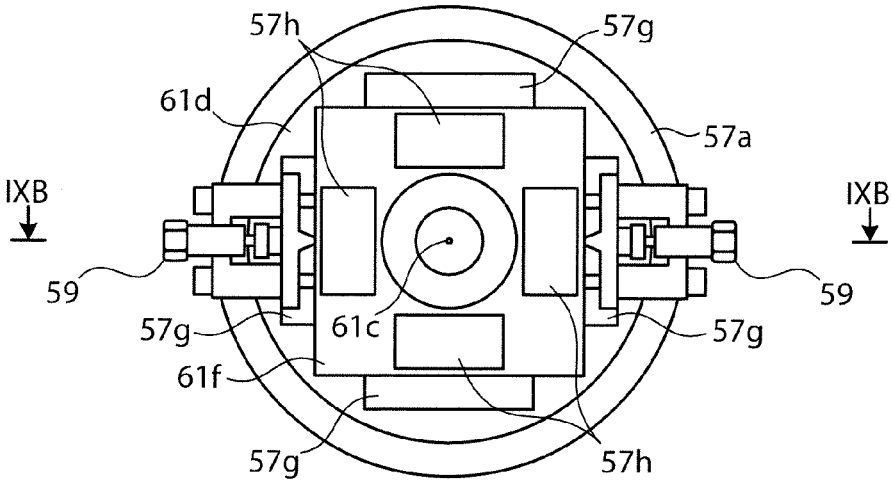
FIG. 9A is a bottom view illustrating a second example of a target supply device.
Figure 9B:
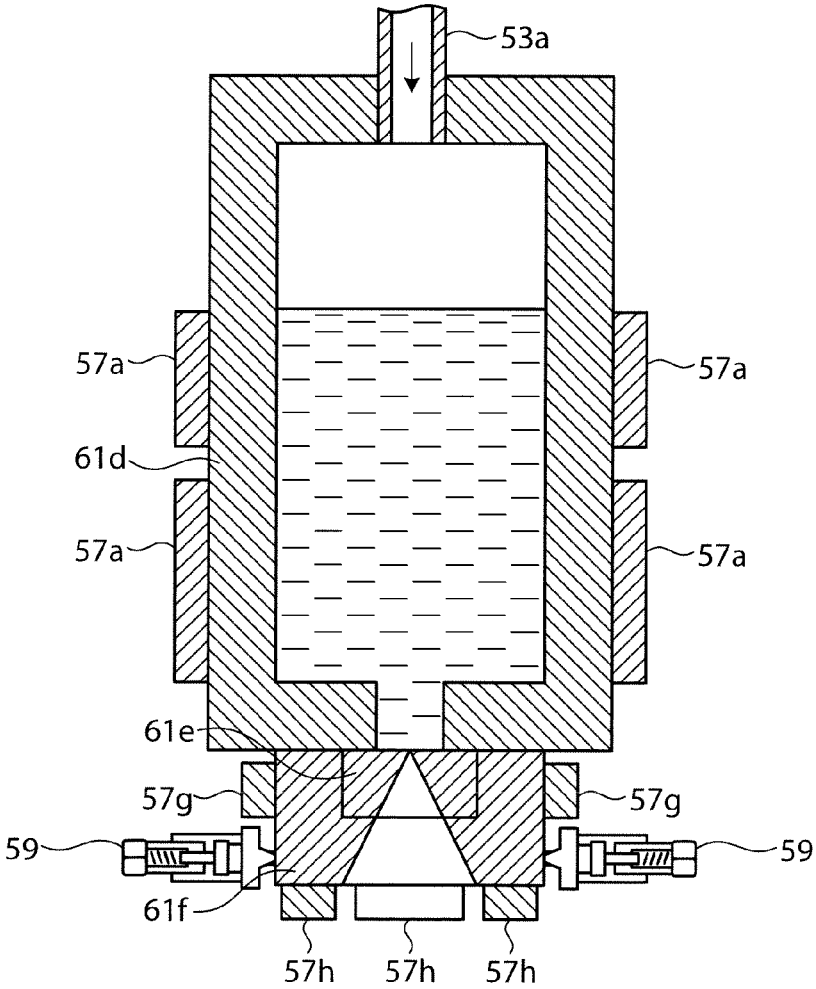
FIG. 9B is a sectional view of the target supply device shown in FIG. 9A, taken along IXB-IXB plane.

FIG. 9A is a bottom view illustrating a second example of a target supply device. FIG. 9B is a sectional view of the target supply device shown in FIG. 9A, taken along IXB-IXB plane.

In the second example, the vibration device 59 may be fixed on the outer surface of the nozzle fixing member 61*f* next to the heater 57*g*. A vibration applied to the nozzle fixing member 61*f* by the vibration device 59 may be propagated to the nozzle member 61*e* through the rigid nozzle fixing member 61*f*. Accordingly, the jet of the target material may be divided into a plurality of droplets.

With the second example, since the propagation path of the vibration from the vibration device 59 to the nozzle member 61*e* is shorter than that in the first example, the vibration may be propagated to the nozzle member 61*e* with ease.

5.3 Third Example

Figure 10A:
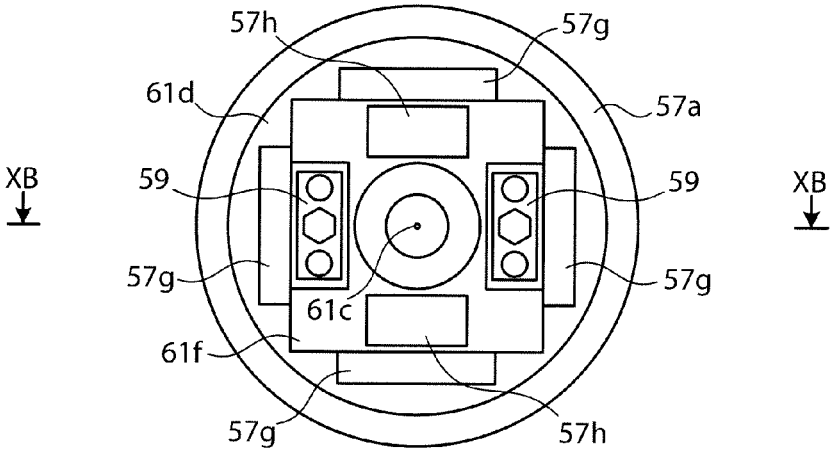
FIG. 10A is a bottom view illustrating a third example of a target supply device.
Figure 10B:
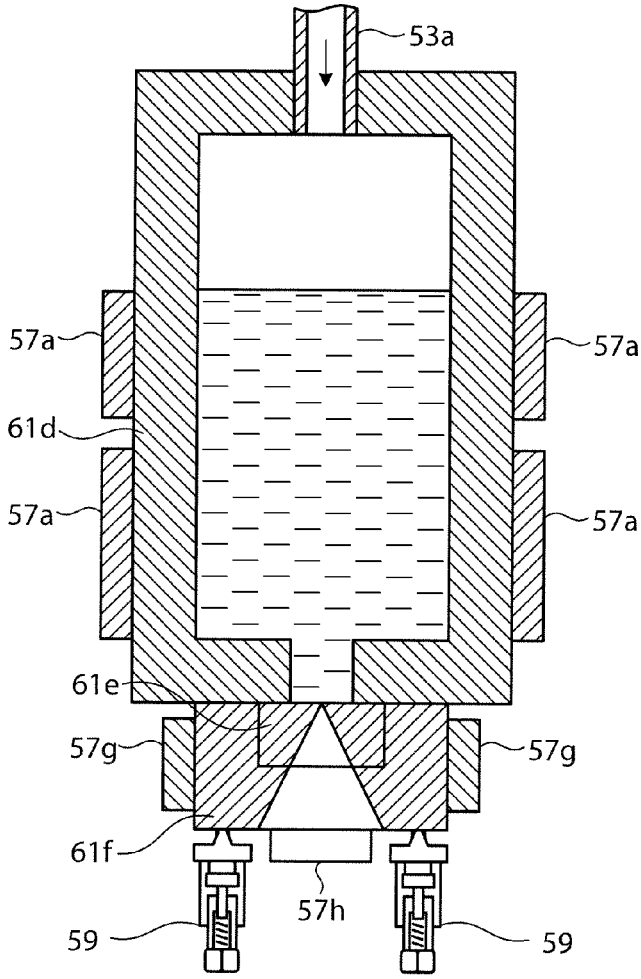
FIG. 10B is a sectional view of the target supply device shown in FIG. 10A, taken along XB-XB plane.

FIG. 10A is a bottom view illustrating a third example of a target supply device. FIG. 10B is a sectional view of the target supply device shown in FIG. 10A, taken along XB-XB plane.

In the third example, the vibration device 59 may be fixed on the bottom surface of the nozzle fixing member 61*f* next to the heater 57*f*. The vibration applied to the nozzle fixing member 61*f* by the vibration device 59 may be propagated to the nozzle member 61*e* through the rigid nozzle fixing member 61*f*. Accordingly, the jet of the target material may be divided into a plurality of droplets.

The above-described examples and the modifications thereof are merely examples for implementing the present disclosure, and the present disclosure is not limited thereto. Making various modifications according to the specifications or the like is within the scope of the present disclosure, and other various examples are possible within the scope of the present disclosure. For example, the modifications illustrated for particular ones of the examples can be applied to other examples as well (including the other examples described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

What is claimed is:

1. A target supply device, comprising:

a target supply device body including a nozzle having a through-hole through which a target material is discharged; and a vibration device comprising a piezoelectric member, an elastic member, a regulating member, and a holding unit, the piezoelectric member being connected to the target supply device body and configured to vibrate in accordance with an externally supplied electric signal, the elastic member being connected to the piezoelectric member and configured to apply a pressure to the piezoelectric member so that the piezoelectric member pushes the target supply device body, the regulating member being connected to the elastic member, the holding unit being connected to the target supply device body and configured to hold the regulating member, and the vibration device being configured to control the pressure to be applied by the elastic member to the piezoelectric member by changing position of the regulating member held by the holding unit.

2. The target supply device according to claim 1, wherein the elastic member is aligned to the direction in which the piezoelectric member vibrates.

3. The target supply device according to claim 1, wherein the vibration device further comprises an intermediate member provided between the target supply device body and the piezoelectric member, the intermediate member being configured to connect the target supply device body and the piezoelectric member, and the intermediate member being configured such that an area of contact between the target supply device body and the intermediate member is smaller than an area of a section of the piezoelectric member along a plane parallel to the area of contact.

4. The target supply device according to claim 1, wherein the vibration device further comprises an intermediate member, a pump, and a cooling device, the intermediate member has a water flow channel formed therein, the intermediate member being provided between the target supply device body and the piezoelectric member, and configured to connect the target supply device body and the piezoelectric member, the pump is connected to the water flow channel and configured to circulate water through the water flow channel, and the cooling device is connected to the water flow channel and, configured to cool the water in the water flow channel.

5. A target supply device, comprising:

a target supply device body including a nozzle having a through-hole through which a target material is discharged; and a vibration device comprising an elastic member, a piezoelectric member, a regulating member, and a holding unit, the elastic member being connected to the target supply device body, the piezoelectric member being connected to the elastic member and configured to vibrate in accordance with an externally supplied electric signal, the regulating member being connected to the piezoelectric member and configured to receive a pressure from the piezoelectric member pushed by the elastic member, the holding unit being connected to the target supply device body and configured to hold the regulating member, and the vibration device being configured to control the pressure to the regulating member from the piezoelectric member pushed by the elastic member by changing position of the regulating member held by the holding unit.

6. The target supply device according to claim 5, wherein the vibration device further comprises an intermediate member, a pump, and a cooling device, the intermediate member having a water flow channel formed therein, the intermediate member being provided between the target supply device body and the elastic member, and configured to connect the target supply device body and the elastic member, the pump being connected to the water flow channel and configured to circulate water through the water flow channel, and the cooling device being connected to the water flow channel and configured to cool the water in the water flow channel.

7. A target supply device, comprising:

a target supply device body comprising a reservoir, a heater, a heater power source, a temperature sensor, a temperature controller, and a pressure adjuster, the reservoir including a nozzle having a through-hole through which a target material is discharged, the heater being arranged to the reservoir, the heater power source being connected to the heater, the temperature sensor being arranged to the reservoir, the temperature controller being connected to the heater power source and the temperature sensor, and the pressure adjuster being connected to an inert gas cylinder and connected to a pipe to supply inert gas from the inert gas cylinder into the reservoir;

a vibration device comprising an intermediate member, a piezoelectric member, a power supply, an elastic member, a regulating member, and a holding unit, the intermediate member being connected to the target supply device body, the piezoelectric member being connected to the intermediate member and configured to vibrate in accordance with an externally supplied electric signal, the power supply being configured to apply a voltage to the piezoelectric member, the elastic member being connected to the piezoelectric member and configured to apply a pressure to the piezoelectric member so that the piezoelectric member pushes the intermediate member, the regulating member being connected to the elastic member, the holding unit being connected to the target supply device body and configured to hold the regulating member, and the vibration device being configured to control the pressure to be applied by the elastic member to the piezoelectric member by changing position of the regulating member held by the holding unit; and a target controller being connected to the temperature controller, the pressure adjuster and the power supply, and configured to control the temperature controller, the pressure adjuster and the power supply so that the target supply device supplies the target material.

8. The target supply device according to claim 7, wherein the intermediate member is configured such that an area of contact between the target supply device body and the intermediate member is smaller than an area of a section of the piezoelectric member along a plane parallel to the area of contact.

9. The target supply device according to claim 7, wherein the vibration device further comprises a pump and a cooling device, the intermediate member has a water flow channel formed therein, the pump is connected to the water flow channel and configured to circulate water through the water flow channel, and the cooling device is connected to the water flow channel and configured to cool the water in the water flow channel.

10. The target supply device according to claim 7, wherein the elastic member comprises a plurality of disc springs.

* * * * *